US008231485B2

(12) United States Patent
Forester

(10) Patent No.: US 8,231,485 B2
(45) **Date of Patent: *Jul. 31, 2012**

(54) DAMPENING SYSTEM FOR A STRINGED-RACQUET

(75) Inventor: Wayne Forester, Asheville, NC (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/283,365

(22) Filed: Oct. 27, 2011

(65) Prior Publication Data

US 2012/0040784 A1 Feb. 16, 2012

Related U.S. Application Data

(63) Continuation of application No. 12/107,054, filed on Apr. 21, 2008, now Pat. No. 8,066,592.

(60) Provisional application No. 60/913,259, filed on Apr. 20, 2007.

(51) Int. Cl.
*A63B 49/00* (2006.01)

(52) U.S. Cl. ..... 473/522; 36/132; 36/136

(58) Field of Classification Search ..... 473/520, 473/522; 36/132, 136

See application file for complete search history.

(56) References Cited

U.S. PATENT DOCUMENTS

| | | | |
|---|---|---|---|
| 2,344,421 | A | 3/1944 | Schwartz |
| 4,458,373 | A | 7/1984 | Maslow |
| 4,575,083 | A | 3/1986 | Adam |
| 4,609,194 | A | 9/1986 | Krent et al. |
| 4,621,441 | A | 11/1986 | Wagner et al. |
| 4,712,319 | A | 12/1987 | Goria |
| 4,732,383 | A | 3/1988 | Ferrari et al. |
| 4,761,007 | A | 8/1988 | Boschian |
| 4,776,590 | A | 10/1988 | Krent et al. |
| 4,909,509 | A | 3/1990 | Boschian |
| 4,911,445 | A | 3/1990 | Ferrari et al. |
| 4,927,143 | A | 5/1990 | Hillock |
| 4,962,928 | A | 10/1990 | Camara et al. |
| 5,022,651 | A | 6/1991 | Barone |
| 5,158,286 | A | 10/1992 | Soong |
| 5,169,146 | A | 12/1992 | Soong |
| 5,211,397 | A | 5/1993 | Davis et al. |
| 5,367,795 | A | 11/1994 | Iverson et al. |
| 5,402,589 | A | 4/1995 | Lubrani et al. |
| 5,538,244 | A | 7/1996 | Gibert |
| 5,673,501 | A | 10/1997 | Mathews |

(Continued)

OTHER PUBLICATIONS

Written Opinion of the International Searching Authority; PCT Application No. PCT/US08/61070; International Filing Date Apr. 21, 2008.

(Continued)

*Primary Examiner* — Raleigh W. Chiu
(74) *Attorney, Agent, or Firm* — Harness, Dickey & Pierce, PLC

(57) ABSTRACT

A method of changing vibration characteristics of a stringed racquet having strings includes providing an article of apparel with a mount thereon. The method also includes providing a slotted vibration dampener. Moreover, the method includes increasing dampening of the stringed raquet by moving the slotted vibration dampener from a first position to a second position. The slotted vibration dampener is removably attached to the mount in the first position. The slotted vibration dampener is removably attached to the strings of the stringed racquet in the second position. The method further includes decreasing dampening of the stringed raquet by moving the slotted vibration dampener from the second position to the first position.

18 Claims, 3 Drawing Sheets

U.S. PATENT DOCUMENTS

| | | | | |
|---|---|---|---|---|
| 5,871,409 | A | 2/1999 | Kimoto | |
| 6,033,324 | A | 3/2000 | Nashif et al. | |
| 6,364,791 | B1 | 4/2002 | Janes | |
| 6,502,329 | B1 | 1/2003 | Silagy | |
| 7,014,579 | B1 | 3/2006 | Sung | |
| 7,335,118 | B1 | 2/2008 | Sung | |
| 7,517,293 | B1 | 4/2009 | Smith | |
| 7,530,910 | B1 | 5/2009 | Niksich et al. | |
| 7,556,575 | B2 | 7/2009 | Lammer et al. | |
| 7,572,196 | B2 | 8/2009 | Kotze et al. | |
| 8,066,592 | B2 * | 11/2011 | Forester | 473/522 |
| 2004/0023738 | A1 | 2/2004 | Sung | |
| 2004/0254034 | A1 | 12/2004 | Tymchyn | |
| 2005/0016028 | A1 | 1/2005 | Safdeye | |
| 2006/0010721 | A1 | 1/2006 | Valko | |
| 2007/0169382 | A1 | 7/2007 | Bongard | |
| 2008/0086917 | A1 | 4/2008 | Carrillo | |
| 2008/0163514 | A1 | 7/2008 | Stassinopoulos | |
| 2008/0271348 | A1 | 11/2008 | Fromm | |
| 2009/0300948 | A1 | 12/2009 | Nordstrom-Wehner | |
| 2010/0005686 | A1 | 1/2010 | Baum | |
| 2010/0011623 | A1 | 1/2010 | Seckler et al. | |

OTHER PUBLICATIONS

International Search Report; PCT Application No. PCT/US08/61070; International Filing Date Apr. 21, 2008.

Notification of Transmittal of the International Search Report; PCT Application No. PCT/US08/61070; International Filing Date Apr. 21, 2008.

Office Action dated Apr. 2, 2010, U.S. Appl. No. 12/107,054, filed Apr. 21, 2008.

Final Office Action dated Dec. 21, 2010, U.S. Appl. No. 12/107,054, filed Apr. 21, 2008.

Office Action dated Apr. 11, 2011, U.S. Appl. No. 12/107,054, filed Apr. 21, 2008.

* cited by examiner

DAMPENING SYSTEM FOR A STRINGED-RACQUET

CROSS-REFERENCE TO RELATED APPLICATION

This application is a continuation of U.S. patent application Ser. No. 12/107,054, filed Apr. 21, 2008, now U.S. Pat. No. 8,066,592, which claims priority to U.S. Provisional Patent Application No. 60/913,259, filed on Apr. 20, 2007.

TECHNICAL FIELD

The following relates to an article of sporting apparel with a vibration dampener for a stringed-racquet detachably secured thereto.

BACKGROUND

The use of vibration dampening devices on stringed sporting racquets, such as tennis racquets, squash racquets, racquetball racquets and the like is widely known. Such dampening devices absorb vibration created when a ball strikes the surface of the racquet, reducing the transmission of the vibration through the strings of the racquet to the handle and ultimately that hand and arm of the player. Vibration that is transferred to the hand and arms can cause sport-related injuries such as "tennis elbow" and the like. In addition, vibration dampeners also help maintain proper string tension, thereby increasing the power exerted by the ratchet on a ball.

Such dampening devices are usually installed on a stringed-racquet in one of two ways. They are installed concurrently when the racquet is strung. Alternatively, they are installed after the racquet is strung, usually by detachably securing the dampener between two adjacent strings.

Because of the forces exerted on the face of the racquet during play, dampening devices, and in particular detachably secured dampening devices, tend to fall out during play. Moreover, players tend to lose, misplace and forget their vibration dampeners when they are detached from their racquets, thereby rendering them useless.

Typically, when a dampening device falls from a racquet during play or a player determines that one or more dampening devices are needed for a particular situation, they cannot be quickly and easily located. Accordingly, a player must either stop the game to locate the dampening device, or continue playing without the benefit of the dampening device.

SUMMARY

Accordingly, despite the benefits of detachably securing a dampening device to a racquet, there remains a need for a system for storing one or more dampeners so that they are easily accessible during play. The present disclosure fulfills these and other needs.

A vibration dampener is detachably secured to an article of footwear. Should a player lose a vibration dampener or elect to add one during play, the player detaches a vibration dampener from the article of footwear and installs the dampener between two adjacent strings on the player's racquet. The player quickly and conveniently replaces the dampener to avoid the undesirable effects of playing without a dampener while not having to postpone play or leave the playing area.

In disclosed embodiments, a replaceable dampening device is detachably secured to the article of footwear by way of an opening in the upper of the shoe, for example, the tongue. Preferably, the opening has a flange that engages a slot located around the lateral edge of the dampening device.

The surface of the dampening device may provide surface ornamentation thereon, such as a logo, other indicia, or a color scheme selectable by the wearer.

The dampening device may also be made of materials of varying vibration absorption capability to accommodate the player's preference of vibration absorption and string tension.

DETAILED DESCRIPTION

Figure 1A:
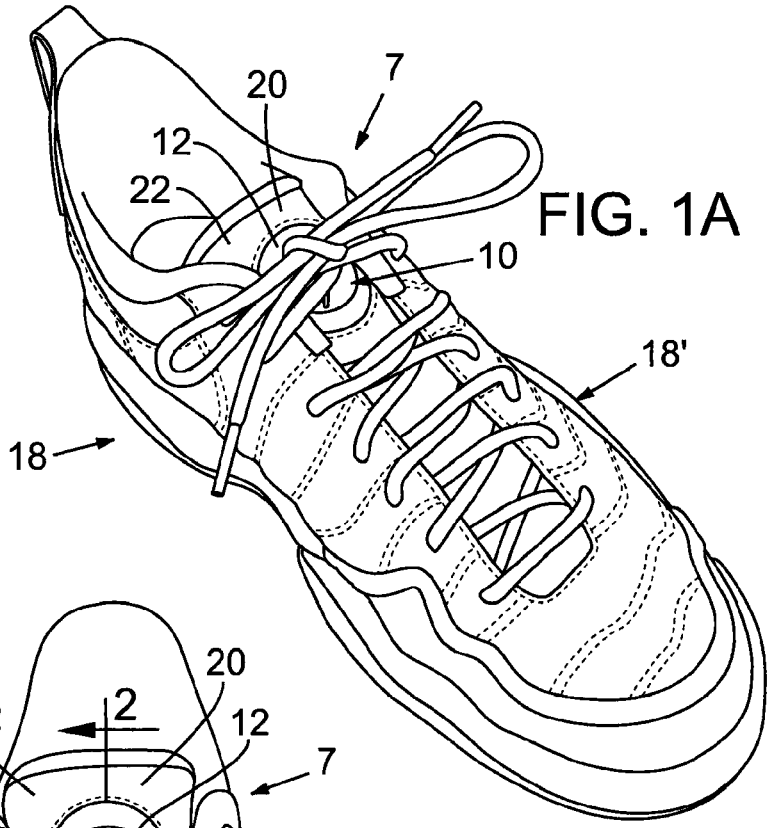
FIG. 1A is a front isometric view of an article of footwear with a replaceable dampening device installed in the tongue of the article of footwear depicting a possible shoelace in a tied position.
Figure 1B:
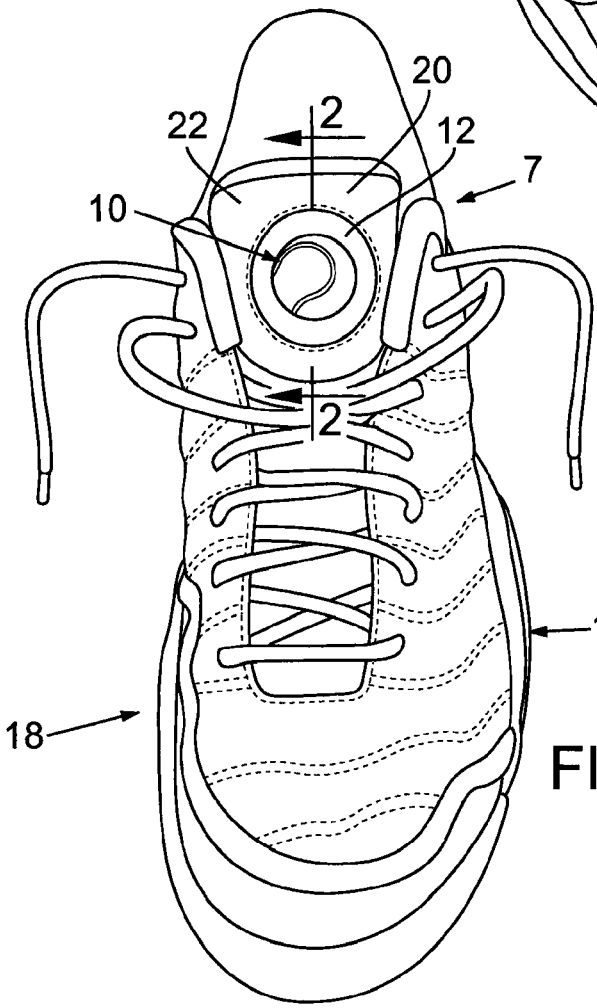
FIG. 1B is a front isometric view of an article of footwear of FIG. 1B with the possible shoelace in an untied position to provide access to the dampening device.
Figure 2:
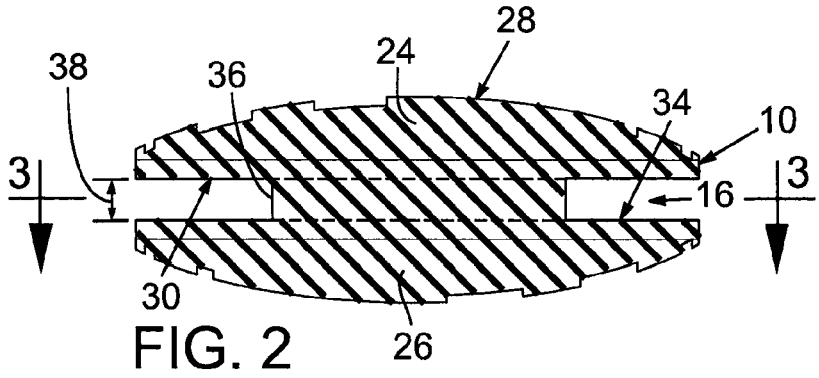
FIG. 2 is a cross-sectional view of the replaceable dampening device taken along line 2-2 of FIG. 1B.
Figure 3:
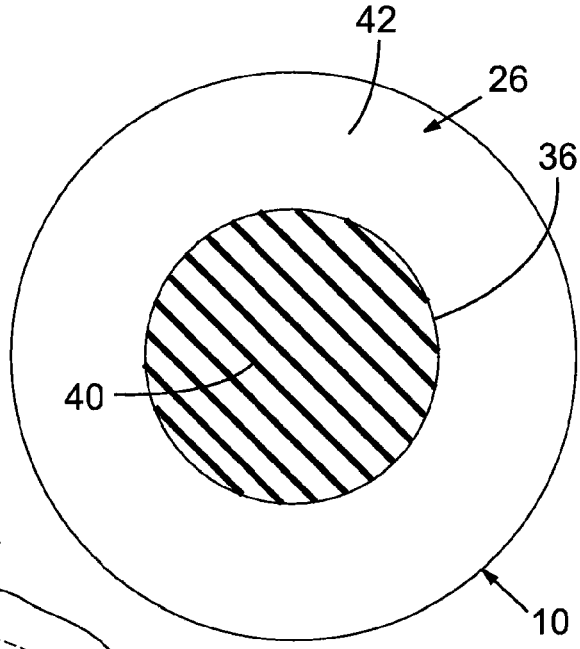
FIG. 3 is a cross sectional view of the dampening device of FIG. 2 taken along line 3-3 of FIG. 2.
Figure 4:
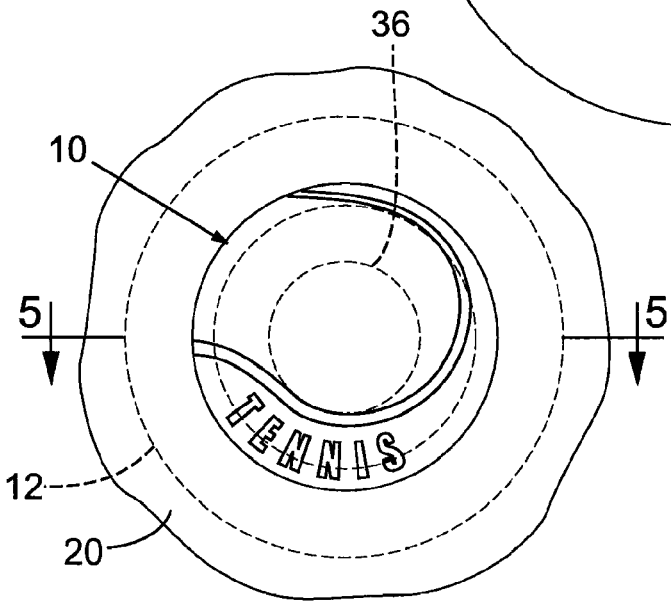
FIG. 4 is a top fragmentary view of a replaceable dampening device of FIG. 2 showing a possible attachment to an article of apparel, shown in partial view.

A dampening system 7 for a stringed-racquet 8 (FIG. 6) is shown in FIGS. 1-6. When not in use on a racquet 8 (FIG. 6), a conventional stringed-racquet dampening device 10 is detachably secured to an article of apparel 18, such as an article of footwear 18' or the like, Preferably, a dampening device mount 12 is operably secured to the article of apparel 18. The mount 12 allows the dampening device 10 to be detachably secured thereto. For example, as best shown in FIGS. 1B, 2, and 4, a flange 14 is preferably secured to the article of apparel 18 for operably engaging a mating recess 16 on the dampening device 10.

Referring to FIGS. 1A and 1B, the article of apparel 18 used in the system is preferably an article of footwear 18' such as a shoe or the like. The article of footwear 18' has an outer surface 20 providing a location for the mount 12. Preferably, the mount 12 is rigidly connected to the outer surface 20 of the article of footwear 18'. The dampening device 10 is detachably secured to the mount 12, preferably by inserting the flange 14 (FIG. 5) into the mating recess 16 in the dampening device 10, thereby being readily available for use as needed.

Preferably, the mount 12 is installed on the tongue 22 of the article of footwear 18'. The mount 12 may also be connected to the article of footwear 18' at on another area of the outer surface 20. The mount 12 and the dampening device 10 can be designed using different characteristics, such as colors, sizes and graphical representations such as logos and the like to present an aesthetically pleasing appearance that coincides with the style of the shoe 18.

Figure 5:
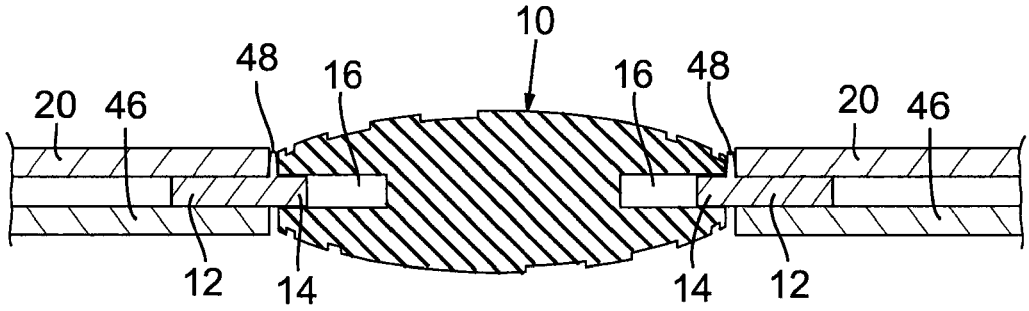
FIG. 5 is a cross sectional view of the dampening device of FIG. 4 along line 5-5 of FIG. 4.

Referring to FIGS. 2-4, a conventional detachably securable vibration dampener 10 is shown. The dampener 10 is made of a resilient material that can vary in hardness to provide different operable characteristics and allows a user to bend the dampener 10 when installing the dampener on a racquet 8 (FIG. 6) or a mount 12 (FIGS. 1*b* and 5). Preferably, the dampener 10 has a first substantially planar member 24 and a second substantially planar member 26. The first substantially planar member 24 has an outer surface 28 and an inner surface 30. Likewise, the second substantially planar member 26 has an outer surface 32 and an inner surface 34. The inner surface 30 of the first planar member 24 and the inner surface 34 of the second planar member 26 are rigidly connected by a columnar member 36 of some depth 38. Preferably, the depth 38 will be slightly smaller than the diameter of a conventional racquet string. The cross-sectional area 40 of the columnar member 36 is preferably smaller than the surface area 42 of the first and second planar members 24 and 26. The difference between the cross-sectional area of the columnar member 36 and surface areas of the planar members 24 and 26, define a void 16 between the first planar member 24 and the second planar member 26 that operably engages the strings of a racquet when in use. When not in use the dampener 10 can be detachably secured to the mount 12 for storage.

Referring to FIGS. 4 and 5, the mount 12 is preferably a flange 14 rigidly secured to the outer surface 20 of the article of apparel 18. Preferably, the mount 12 is inserted into an opening 44 in the outer surface 20 of the article 18 and rigidly secured to the article of apparel 18 between an outer layer 20 and an inner layer 46 of the article 18. The mount 12 extends inward toward the center of the opening 44 creating a flange 14 that engages the mating void 16 in the dampener 10. The resilient material of the dampener 10 allows the user to bend the dampener 10 to fit into the opening 44 and engage the flange 14 into the mating void 16. Conversely, the user can pull on the dampener 10, disengaging the flange 14 from the void 16, removing the dampener 10 so it can be installed in a racquet. Preferably the mount 12 has a protrusion 48 perpendicular to the lateral surface of the flange 14. The protrusion extends from the flange 14 through the outer surface 20 of the article 18, preventing movement of the mount from its alignment with the opening 44. While the preferred embodiment shows the mount 12 installed in an opening in the outer surface 20 of the article 18, it is also contemplated that the mount may also be rigidly secured to the outer surface by things such as snaps, hook and loop material, buttons and the like.

Figure 6:
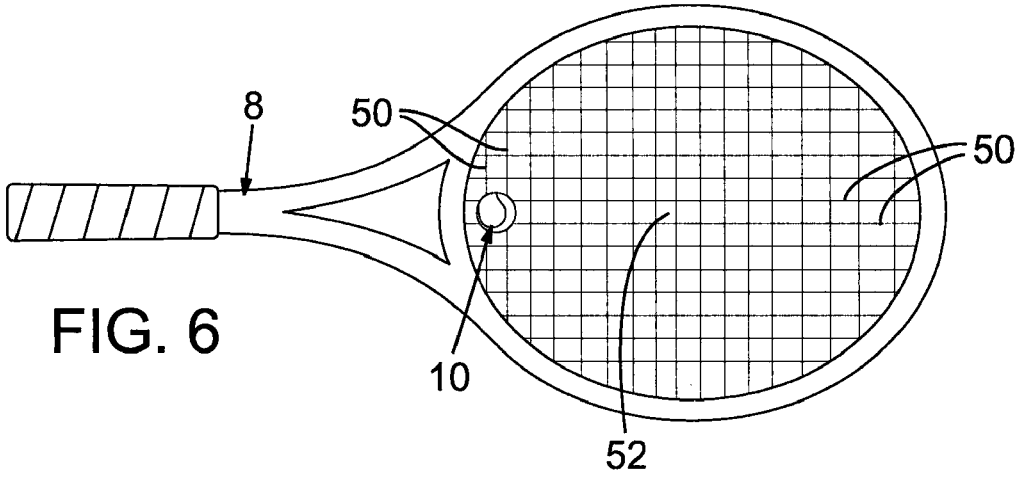
FIG. 6 is a front plan view of the dampening device 10 of FIG. 1B, showing a possible installation on a racquet.

Referring to FIG. 6, a racquet 8 with the dampener 10 detachably secured thereto is shown. The dampener 10 is inserted between adjacent strings 50 of the racquet face 52. When the racquet face 52 strikes a ball, vibration created by the impact is absorbed by the dampener through the strings 50.

To use the system, a player who finds that while using a strung racquet, is experiencing undesirable effects such as discomfort, loss of power or the like or a player who loses a detachably secured dampener from a racquet face, reaches a dampener 10 that is detachably secured to the mount 12 located somewhere on an article of apparel 18. The player removes the dampener 10 from the mount 12 by pulling on the dampener with enough force to disengage the dampener 10 from the mount 12. Once removed, the resilience of the material forming the dampener will cause it to return to its original shape and size. Once removed from its mount 12, the dampener is installed on the racquet 8 by inserting the dampener between two adjacent strings 50 in the racquet face and bending the dampener to engage each adjacent string into the mating void in the dampener. The resilient material of the dampener 10 returns to its original shape and size such that it is in contact with each of the adjacent strings and operably secured thereto.

Preferably, a plurality of mounts 12 are provided on the article of apparel 18. Accordingly, a plurality of dampeners 10, each having different physical properties such as hardness and the like can be detachably secured to the article of apparel 18. When using the system, the player then has a choice of dampener properties to choose from and may remove the dampener that provides the most benefit based on the playing conditions and the player's preferences.

When dampeners are not in use as a racquet, the dampeners preferably contain decorative features on their outer surfaces such as logos, graphical indicia, text, colors and the like. Preferably, the mounts 12 will be located in a visible location on the article of apparel allowing the player to personalize their apparel through the displaying of dampeners bearing indicia such as the player's favorite color, manufacturer, sports team and the like. In this way, the system serves to provide an aesthetically pleasing and customizable ornamentation for the article of apparel even when not being used in conjunction with a racquet.

Accordingly, the present disclosure includes all such modifications as may come within the scope of the following claims and equivalents thereto.

What is claimed is:

1. A method of changing vibration characteristics of a stringed racquet having strings, the method comprising:

providing an article of apparel with a mount thereon;

providing a slotted vibration dampener;

increasing dampening of the stringed racquet by moving the slotted vibration dampener from a first position to a second position, the slotted vibration dampener being removably attached to the mount in the first position, the slotted vibration dampener being removably attached to the strings of the stringed racquet in the second position; and decreasing dampening of the stringed racquet by moving the slotted vibration dampener from the second position to the first position.

2. The method of claim 1, wherein providing an article of apparel includes manufacturing the mount and attaching the mount to the article of apparel.

3. The method of claim 1, wherein providing the slotted vibration dampener includes manufacturing the slotted vibration dampener.

4. The method of claim 1, wherein providing the slotted vibration dampener includes providing the slotted vibration dampener with a surface ornamentation thereon.

5. The method of claim 1, wherein the mount includes a flange, and wherein providing the article of apparel includes extending the flange from an opening in the article of apparel.

6. The method of claim 1, wherein the article of apparel is an article of footwear.

7. The method of claim 6, wherein the article of footwear includes a tongue, and wherein providing the article of apparel includes providing the article of footwear with the mount secured to the tongue.

8. The method of claim 1, wherein the mount includes a flange, and wherein moving the slotted vibration dampener from the second position to the first position includes removably attaching the slotted vibration dampener to the flange.

9. The method of claim 8, wherein the slotted vibration dampener includes a mating recess therein, and wherein moving the slotted vibration dampener from the second position to the first position includes receiving the flange within the mating recess.

10. A method of changing vibration characteristics of a stringed racquet having strings, the method comprising:

providing an article of apparel with a first mount and a second mount thereon;

providing a first slotted vibration dampener and a second slotted vibration dampener, the first slotted vibration dampener and the second slotted vibration dampener having different dampening properties;

selecting one of the first and second slotted vibrations to use for changing dampening of the stringed racquet; and changing dampening of the stringed raquet by moving the one of the first and second slotted vibration dampeners from a first position to a second position while the other of the first and second slotted vibration dampeners remains in a third position, the one of the first and second slotted vibration dampeners being removably attached to the first mount in the first position, the one of the first and second slotted vibration dampeners being removably attached to the strings of the stringed racquet in the second position, the other of the first and second slotted vibration dampeners being removably attached to the second mount in the third position.

11. The method of claim 10, further comprising selecting the other of the first and second slotted vibrations to use to change dampening of the stringed racquet, moving the one of the first and second slotted vibrations from the second position to the first position, and moving the other of the first and second slotted vibration dampeners from the third position to a fourth position in which the other of the first and second slotted vibration dampeners is removably attached to the strings of the stringed racquet.

12. The method of claim 10, wherein the first and second slotted vibration dampeners have different hardnesses.

13. The method of claim 10, wherein providing an article of apparel includes manufacturing the first mount and the second mount and attaching the first mount and the second mount to the article of apparel.

14. The method of claim 10, wherein providing the first and second slotted vibration dampeners includes manufacturing the first and second slotted vibration dampeners.

15. The method of claim 10, wherein at least one of the first and second mounts includes a flange, and wherein providing the article of apparel includes extending the flange from an opening in the article of apparel.

16. The method of claim 10, wherein the article of apparel is an article of footwear.

17. The method of claim 10, wherein the first mount includes a flange, and wherein moving the first slotted vibration dampener from the second position to the first position includes removably attaching the first slotted vibration dampener to the flange.

18. The method of claim 17, wherein the first slotted vibration dampener includes a mating recess therein, and wherein moving the first slotted vibration dampener from the second position to the first position includes receiving the flange within the mating recess.

* * * * *